US005765760A

United States Patent [19]

Kuo

[11] Patent Number: 5,765,760

[45] Date of Patent: Jun. 16, 1998

[54] SHOWER HEAD WITH TWO DISCHARGE VARIATIONS

[75] Inventor: Lu-Wen Kuo, Changhua Hsien, Taiwan

[73] Assignee: Will Daih Enterprise Co., Ltd., Changhua Hsien, Taiwan

[21] Appl. No.: 752,518

[22] Filed: Nov. 20, 1996

[51] Int. Cl.[6] ..... B05B 1/14

[52] U.S. Cl. ..... 239/440; 239/437; 239/447; 239/552

[58] Field of Search ..... 239/436, 437, 239/440, 444, 447, 548, 552, 525, 526

[56] References Cited

U.S. PATENT DOCUMENTS 4,203,550 5/1980 On ..... 239/102

4,209,132 6/1980 Kwan ..... 239/381

4,588,130 5/1986 Trenary et al. ..... 239/381

*Primary Examiner*—Lesley D. Morris

*Assistant Examiner*—David Deal

*Attorney, Agent, or Firm*—Bacon & Thomas

[57] ABSTRACT

An easy-to-assemble shower head having two variations of water discharge is characterized in that water is selectively discharged via 3 paired discharge pores on an intermittent discharge cap in a volume variable manner for effecting massaging purpose due to the use of an intermittent discharge wheel or is sprinkled at a wide angle via multiple ditches defined on a water dispensing ring member and the intermittent discharge cap as long as an adjusting member is selectivley rotated.

1 Claim, 5 Drawing Sheets

SHOWER HEAD WITH TWO DISCHARGE VARIATIONS

BACKGROUND OF THE INVENTION

The present invention relates to an easy-to-assemble shower head with two discharge variations. The shower head is equipped with an adjusting member which can be rotated to vary the path of discharge of water whereby water can be sprinkled at a wide angle or is jetted with its volume variable out of 3 paired outlet pores, effecting a massaging purpose. The intermittent variation of volume of discharged water results from an intermittent discharge wheel roatable due to water impact. The wheel is provided with a stop plate which attributes to the volume variation in turn when the wheel is made to rotate by the impact of water.

A conventional shower head having the same effects as the present invention is generally designed to have a plurality of components which are structured in a complex and difficult manner and are time and labor consuming when assembled together, making the production cost high and less competitive in markets.

SUMMARY OF THE INVENTION

Therefore, the primary object of the present invention is to provide an easy-to-assemble shower head having two discharge variations, i.e., a common sprinkling form and an intermittent discharge form having massaging effect.

DETAILED DESCRIPTION OF THE PREFERRED EMBODIMENT

Figures 1, 1A, 1B:
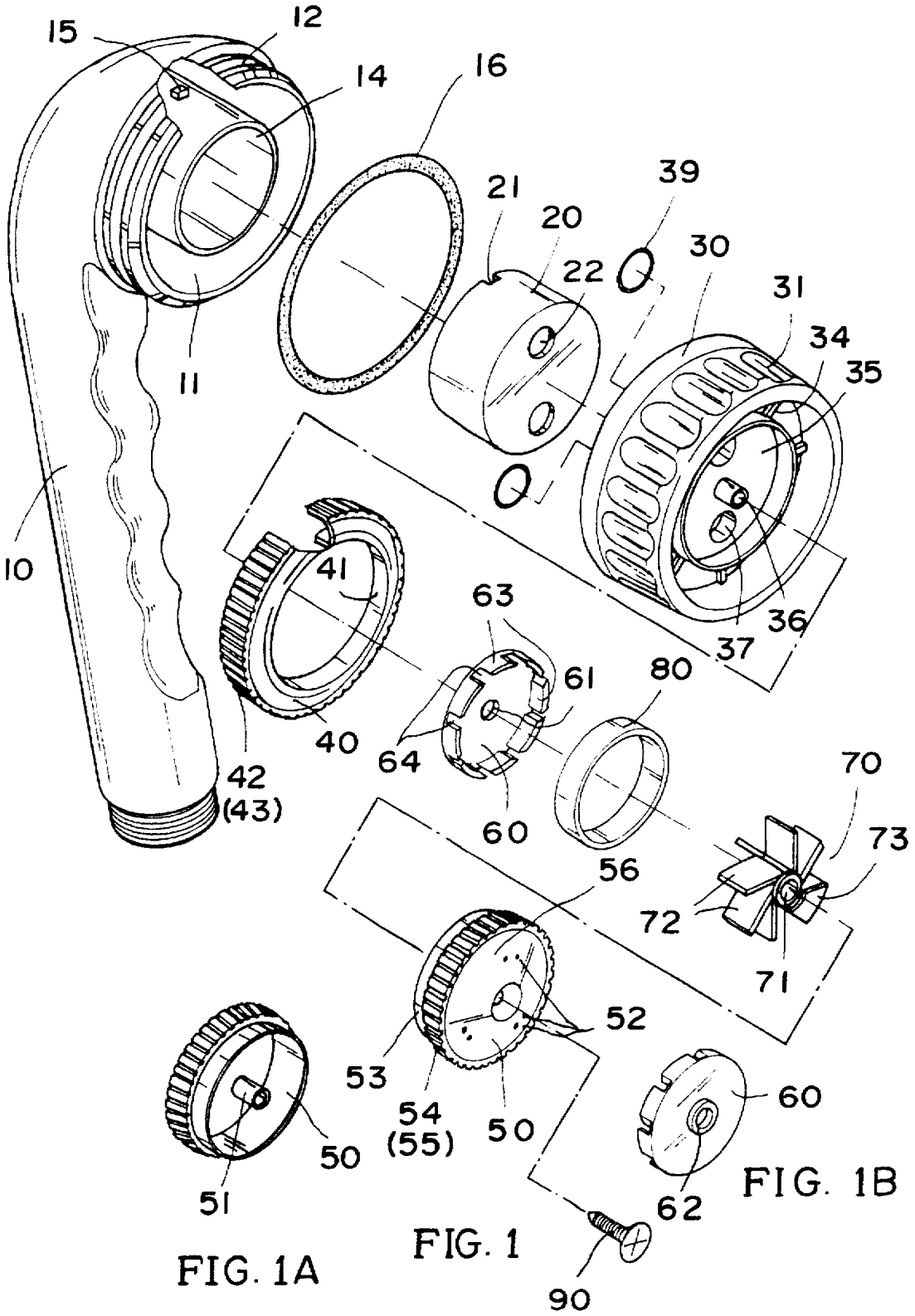
FIG. 1 is a perspective diagram showing the exploded components of the present invention.
FIG. 1A is a diagram showing the intermittent discharge cap from the other side thereof.
FIG. 1B is a diagram showing the limiting board from the other side thereof.

Referring to FIG. 1, an easy-to-assemble shower head with two discharge variations of the present invention is mainly comprised of a shower head embodiment 10; a discharge cap 20; an adjusting member 30; a 3-sided water dispensing ring member 40; an intermittent discharge cap 50; a limiting board 60; an intermittent discharge wheel 70 and a ring hoop 80.

Figure 3:
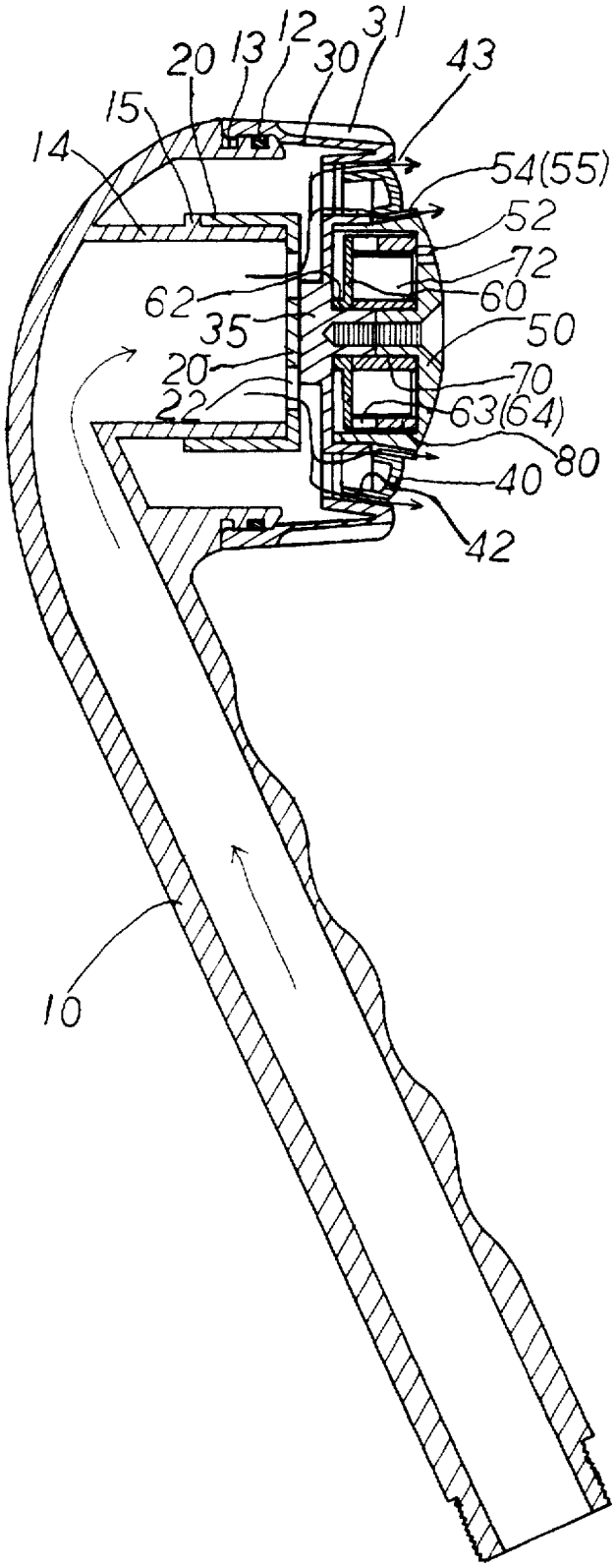
FIG. 3 is a sectional diagram showing the operation mode of the present invention.

The shower head embodiment 10 has a hollow handle terminating in an enlarged water discharge head 11 which is provided with a sealing groove 12 and a retaining groove 13 on the periphery thereof, as shown in FIGS. 1, 3. The hollow handle terminates in a tubular outlet 14.

An O-shaped seal ring 16 is housed in the peripheral sealing groove 12 of the shower head embodiment 10. The discharge cap 20 is integrally produced in a cylindrical form with one end opened and the other closed, and has an inner diameter slightly larger than the tubular outlet 14 so as to permit the cap 20 to be tightly attached to the tubular outlet 14 of the shower head embodiment 10 in assembly.

The discharge cap 20 has two round holes 22 disposed on the wall at the closed end thereof and has a retaining recess 21 at the peripheral edge of the opened end thereof. The retaining recess 21 is engaged with a limiting protrusion 15 defined on the tubular outlet 14 when the cap 20 is mounted onto the tubular outlet 14 so as to stop the cap 20 from rotation.

Figure 4:
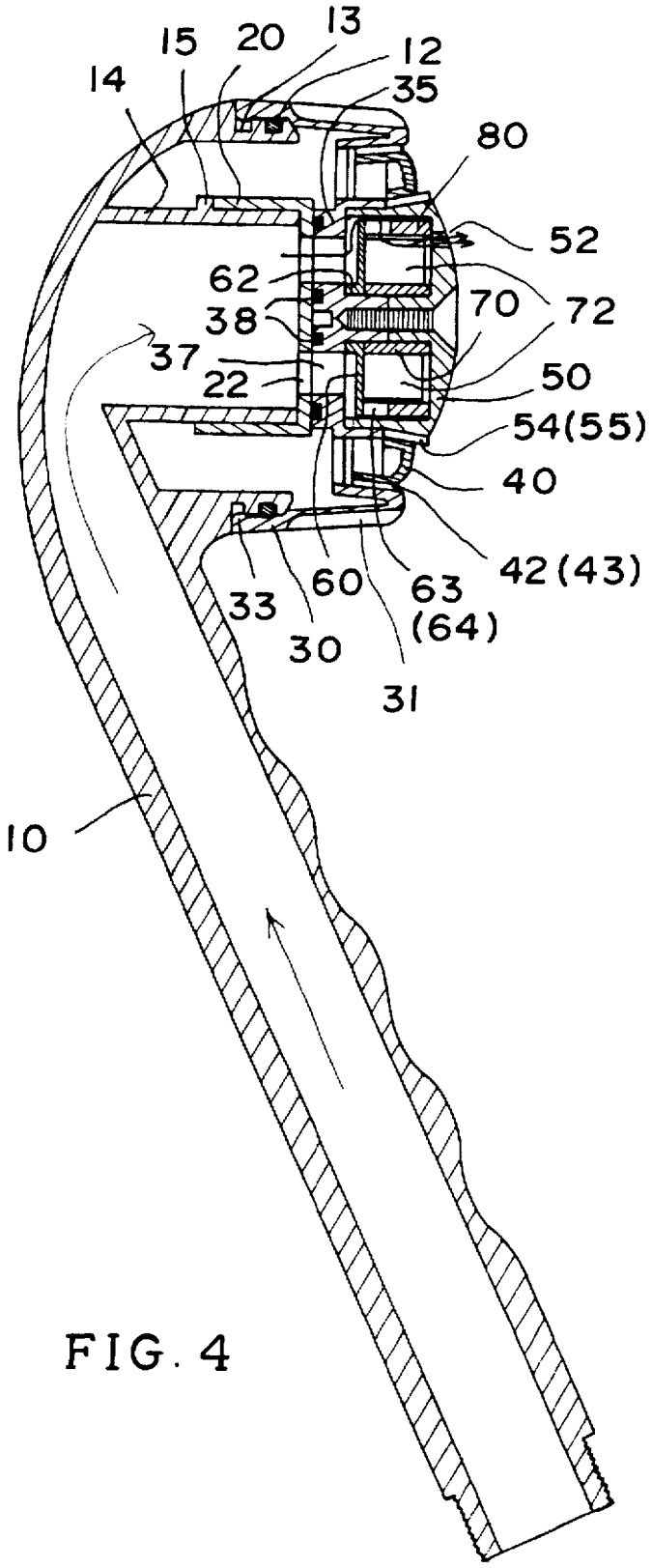
FIG. 4 is a sectional diagram showing another operation mode thereof.
Figure 5:
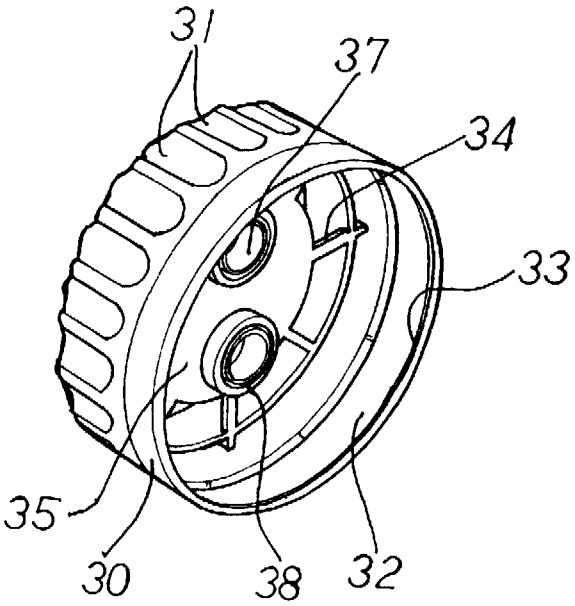
FIG. 5 is a perspective diagram showing the adjusting member of the present invention.

The adjusting member 30 is integrally formed in a short cylindrical shape with a plurality of serially spaced gripping grooves 31 defined on the peripheral wall thereof. The adjusting member 30 has a slightly axially tapered end portion with a retaining flange 33 defined at the front edge thereof, as shown in FIG. 4. Moreover, the adjusting member 30 has a short central tubular partition wall 35 reinforced in place by a plurality of evenly spaced supporting ribs 34. The tubular partition wall 35 has one closed end wall, on which a pair of outlet holes 37 are defined, at one terminal and is left opened at the other so as to permit water to flow either inside the partition wall 35 or outside thereof selectively in operation.

At the center of the closed end wall of the tubular partition wall 35 is disposed an innerly threaded tubular post 36 with the two outlet holes 37 symmetrically disposed by the post 36. The outlet holes 37 can be located in registry or out of registry with the round holes 22 of the discharge cap 20. Each outlet hole 37 is further provided with a receiving groove 38, as shown in FIG. 4 at one end thereof for accommodation of a small O-shaped sealing ring 39.

The water dispensing ring member 40 is three sided with one side left opened and has an outer peripheral wall 42 and an inner peripheral wall 41. On the outer wall 42 are disposed a plurality of evenly spaced axially oriented discharge ditches 43 for distribution of water.

The intermittent discharge cap 50 has a short axially extended structure with an axial post 51 having inner threads projected from the rear side of a front wall 56 of the discharge cap 50. On the front wall 56 are there 3 pairs of symmtrically disposed intermittent discharge pores 52 through which water can be discharged.

A plurality of axially oriented, evenly spaced discharge ditches 54 are disposed on an axially tapered outer periphery 55 defined at the front portion of a peripheral wall 53 of the intermittent discharge cap 50.

The limiting board 60 for effecting intermittent discharge of water has a central hole 61 for engagement of itself with the central post 51 of the intermittent discharge cap 50 in assembly. The central hole 61 has a journalled flange 62 on one side of the limiting board 60 so as to keep the limiting board 60 and the intermittent discharge cap 50 a distance apart. The limiting board 60 has an axially extended peripheral wall 63 divided by a plurality of evenly spaced discharge recesses 64.

The intermittent discharge wheel 70 has a central tubular sleeve 71 onto which are mounted evenly 8 tangentially extended blades 72 and two of the blades 72 are conntected to each other by a stop plate 73.

A ring hoop 80 has a longitudinal width and has a diameter of such that the ring can be just fit in abutment against the divided wall of the limiting board 60.

In assembly, the discharge cap 20 is first attached to the tubular outlet 14 of the shower head embodiment 10. Then the ring hoop 80 is housed in the intermittent discharge cap 50. The tubular sleeve 71 of the intermittent discharge wheel 70 is engaged with the axial post 51 of the cap 50, afterwards, the limiting board 60 is also inserted into the cap 50 and is positioned in abutment against the ring hoop 80 end to end with the discharge wheel 70 confined inside the ring hoop 80 and the limiting board 60. The above assembly as a whole is fitted into the water dispensing ring member 40. The inner peripheral wall 41 is slightly tapered in the axial direction in just fit conformance :to the axially tapered outer periphery 55 of the intermittent discharge cap 50, as shown in FIGS. 3, 4, so as to tightly retain the cap 50 and the ring member 40 together.

Figure 2:
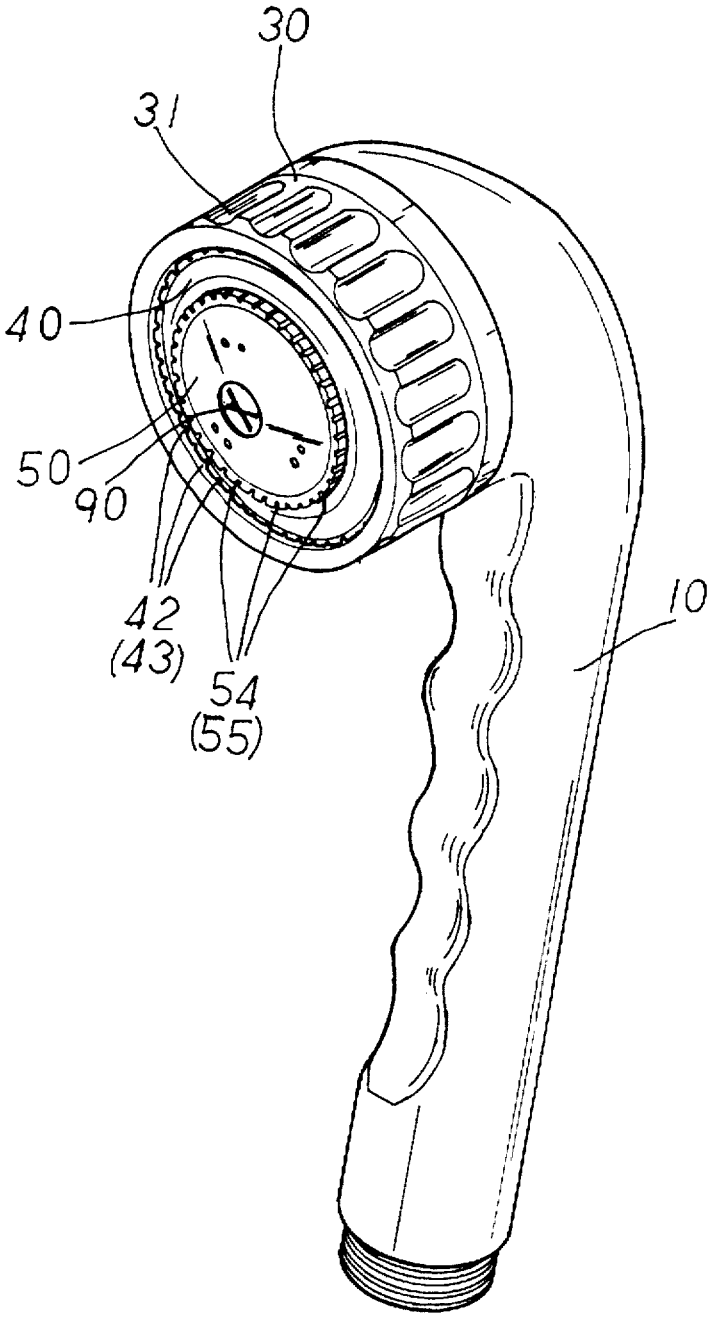
FIG. 2 is a perspective diagram showing the assembled shower head of the present invention.

Then the ring member 40 and the intermittent discharge cap 50 are integrally engaged with the adjusting member 30. The peripheral wall 53 of the discharge cap 50 is fitly confined in the tubular partition wall 35 of the adjusting member 30 and the innerly threaded post 36 of the adjusting member 30 is positioned in alignment with the post 51 of the intermittent discharge cap 50 and goes through the central hole 61 of the limiting board 60 so as to permit a screw 90, as shown in FIG. 2, to lock the assemblies together integrally. Finally the O-shaped sealing ring 16 is placed in the groove 12 of the shower head embodiment 10 and the assembled adjusting member 30 is snapped into engagement with the shower head embodiment 10 by way of the retaining groove 13 of the shower head embodiment, as shown in FIGS. 3, 4, to complete the assembly of the shower head of the present invention.

Referring to FIG. 3, when the adjusting member 30 is rotated in such a manner that the two outlet holes 37 thereof come out of registry with the two round holes 22 of the discharge cap 20, water is then led outside the tubular partition wall 35 and discharged via the multiple ditches 43 of the adjusting member 40 and the multiple ditches 55 defined on the outer periphery 55 of the discharge cap 50, as shown in FIG. 3, in a sprinkling manner.

Referring further to FIG. 4, when the adjusting member 30 is rotated in such a manner that the two outlet holes 37 come in registry with the two round holes 22 of the discharge cap 20, water is led into the tubular partition wall 35 and flows via the multiple discharge recesses 64 on the axially extended peripheral wall 63 of the limiting board 60 and forces the intermittent discharge wheel 70 to spin, water is further discharged via the 3 paired discharge pores 52. The stop plate 73 disposed between two of the wheel blades 72 will be rotated in turn to vary the volume of discharged water via the paired discharge pores 52 intermittently, making the jetted water vary in volume so as to produce a strong and a weak status in turn for effecting massaging purpose.

I claim:

1. An easy-to-assemble shower head with two discharge variations, comprising:

a shower head embodiment having a hollow handle and terminating in an enlarged water discharge head having a sealing groove and a retaining groove on the periphery thereof; and said hollow handle terminating in a tubular outlet;

an O-shaped seal ring housed in said sealing groove of said shower head embodiment;

a discharge cap integrally produced having an inner diameter slightly larger than said tubular outlet, permitting said cap to be tightly attached to said tubular outlet of said shower head embodiment;

said discharge cap having two round holes disposed on one side wall thereof and having a retaining recess disposed at a peripheral edge thereof and engaging with a limiting protrusion defined on said tubular outlet so as to stop said cap from rotation;

an adjusting member integrally formed and having a short cylindrical structure with a plurality of serially spaced gripping grooves defined on the peripheral wall thereof; and having a slightly tapered end portion with a retaining flange defined at the edge thereof;

said adjusting member having a short tubular partition wall supported in place by a plurality of evenly spaced reinforcement ribs at the central portion of said adjusting member so as to permit water to be selectively flowing either inside said tubular partition wall or outside thereof;

said tubular partition wall having an closed end wall at one end and being opened at the other end;

at the center of said closed end wall of said tubular partition wall being disposed an innerly threaded tubular post with two outlet holes symmetrically disposed by said post;

each said outlet hole being provided with a receiving groove at one end thereof for accommodation of a small O-shaped ring;

a 3-sided water dispensing ring member having an outer peripheral wall and an inner peripheral wall; on said outer peripheral wall being disposed a plurality of evenly spaced axially oriented discharge ditches;

an intermittent discharge cap having a short cylindrical extension with a post having inner threads disposed on the rear side of a front wall of said discharge cap;

on said front wall being disposed a number of paired intermittent discharge pores;

a plurality of axially oriented evenly spaced discharge ditches being disposed on the axially tapered outer periphery of said intermittent discharge cap;

a limiting board for intermittent discharge having a central hole for engagement of itself with said central post of said intermittent discharge cap; said central hole having a journalled flange on one side of said limiting board so as to keep the limiting board and the intermittent discharge cap a distance apart; said limiting board having an axially extended peripheral wall provided with a plurality of evenly spaced discharge recesses;

an intermittent discharge wheel having a central tubular sleeve to which are mounted evenly 8 tangentially extended blades and two of said blades being conntected to each other by a stop plate;

a ring hoop having a certain longitudinal width and having a the same diameter as said ring limiting board so as to permit the ring hoop to be in abutment against the divided wall of said limiting board when positioned end to end in assembly;

said adjusting member being snapped into engagement with said shower head embodiment after said discharge cap first secured to said tubular outlet of said shower head embodiment; then said ring hoop being inserted in said intermittent discharge cap and said intermittent discharge wheel being engaged with said post of said cap; next, said limiting board being inserted too in said intermittent discharge cap and abutting against said ring hoop end to end; said assembled intermittent discharge cap being housed inside said 3-sided water dispensing ring member; said water dispensing ring member along with said assembled intermittent discharge cap being housed inside said adjusting member with said central post of said adjusting member leading through said central hole of said limiting board so as to permit said intermittent discharge cap assembly and said water dispensing ring member to be fixed in place to said adjusting member by a screw;

whereby water can be discharged either through said intermittent discharge cap when said adjusting member is turned to make said outlet holes of said adjusting member come into registry with said round holes of said discharge cap or through said ditches of said water dispensing ring member and said intermittent discharge cap when said outlet holes of said adjusting member are turned out of registry with said round holes of said discharge cap.

* * * * *